US011576425B2

(12) United States Patent
Munawar et al.

(10) Patent No.: US 11,576,425 B2
(45) Date of Patent: Feb. 14, 2023

(54) SELF-CLEANING CIGARETTE MANUFACTURING MACHINE

(71) Applicants: Sajid Munawar, Everett, WA (US); Rashad Munawar, Round Rock, TX (US)

(72) Inventors: Sajid Munawar, Everett, WA (US); Rashad Munawar, Round Rock, TX (US)

( * ) Notice: Subject to any disclaimer, the term of this patent is extended or adjusted under 35 U.S.C. 154(b) by 220 days.

(21) Appl. No.: 16/921,618

(22) Filed: Jul. 6, 2020

(65) Prior Publication Data

US 2022/0000169 A1 Jan. 6, 2022

(51) Int. Cl.
*A24C 5/02* (2006.01)

(52) U.S. Cl.
CPC ..... *A24C 5/02* (2013.01)

(58) Field of Classification Search
None
See application file for complete search history.

(56) References Cited

U.S. PATENT DOCUMENTS 2,048,411 A * 7/1936 Schweinsberger ..... A24F 3/02 131/245
3,721,247 A 3/1973 Paytner
3,757,973 A 9/1973 Lambert et al.
4,658,837 A 4/1987 Ruppert et al.
4,770,191 A 9/1988 Muscovitch
4,974,390 A 12/1990 Gill et al.
5,048,267 A 9/1991 Kudo et al.
5,054,346 A 10/1991 Heitman
5,141,000 A 8/1992 Ruppert et al.
5,526,825 A 6/1996 Ruppert et al.
5,536,118 A 7/1996 Schmidt et al.
5,566,812 A 10/1996 Irikura
5,931,278 A 8/1999 Watanabe
6,240,707 B1 6/2001 Ford et al.
6,345,624 B1 2/2002 Kastner
6,484,867 B2 11/2002 Spatafora et al.
6,739,343 B1 * 5/2004 Trinkies ..... A24C 5/42 131/66.1
6,913,022 B2 7/2005 Moser et al.
(Continued)

FOREIGN PATENT DOCUMENTS

CN 202192642 U * 4/2012
CN 205456015 8/2016
(Continued)

*Primary Examiner* — Phu H Nguyen
(74) *Attorney, Agent, or Firm* — Timothy E. Siegel Patent Law, PLLC; Timothy E. Siegel

(57) ABSTRACT

A cigarette assembly machine that accepts loose shredded plant material ("SPM") and cigarette blanks that include a filter and an empty SPM holding portion and produces cigarettes. The machine has an SPM slug forming mechanism, adapted to accept loose SPM and form it into a slug of SPM in the shape of the SPM holding portion and a cigarette blank accepting and holding mechanism, adapted to hold the cigarette blank. Further, a shaft and a two-stroke shaft moving assembly is adapted to push the SPM slug into the holding portion. Finally, the shaft includes a solid distal push tip, an intermediate brush, and a proximal shaft, whereby as the shaft is moved through its strokes, the intermediate brush scrubs the SPM slug forming mechanism.

4 Claims, 9 Drawing Sheets

(56) References Cited

U.S. PATENT DOCUMENTS

| | | | | |
|---|---|---|---|---|
| 7,537,013 | B2 | 5/2009 | Nelson et al. | |
| 9,232,818 | B1 * | 1/2016 | Munawar | A24C 5/02 |
| 10,028,618 | B1 | 7/2018 | Benson | |
| 2006/0272653 | A1 | 12/2006 | Thomas | |
| 2007/0289601 | A1 | 12/2007 | Pham et al. | |
| 2008/0156335 | A1 | 7/2008 | Bajouet | |
| 2011/0011411 | A1 | 1/2011 | Accordino | |
| 2011/0011877 | A1 | 1/2011 | Laplante | |
| 2011/0056504 | A1 | 3/2011 | Laplante | |
| 2011/0265805 | A1 | 11/2011 | Laplante | |
| 2011/0303230 | A1 | 12/2011 | Thiry | |

FOREIGN PATENT DOCUMENTS

| | | | |
|---|---|---|---|
| CN | 106072759 | | 11/2016 |
| GB | 190920721 | A | 9/1910 |
| GB | 191108969 | A | 7/1912 |
| GB | 814383 | A | 6/1959 |

* cited by examiner

SELF-CLEANING CIGARETTE MANUFACTURING MACHINE

BACKGROUND

There is an advantage to a store that sells tobacco or other plant leaf material, including herbs and botanical blends that are high in resins (henceforth collectively, "shredded plant material" or "SPM"), in providing a machine for customer use, that accepts cigarette blanks and loose SPM, and produces finished cigarettes. Although such machines currently exist, these machines suffer from a number of drawbacks. When forming cigarettes from plant material that is moister than cured tobacco, the machinery that is used to form a slug of tobacco for delivery to a cigarette blank tends to become jammed with the sticky remnants of the moist plant material from previous slugs, as the process continues from one slug to the next.

Also, ease and simplicity of use is extremely important for this type of machine, as minimally trained customers are to use it. Unfortunately, currently available customer operated cigarette machines are not as simple to operate as would be desirable. Second, high reliability and easy servicing is very important for any machines that is used in a small shop setting, by a shop owner who may not have a high level of mechanical skills, and for whom the need to repair a machine would constitute a very unwelcome intrusion into an already busy schedule. Moreover, in this case machine down time results in a loss of revenue, which may never be recouped. Unfortunately, currently available machines require a fairly high level of maintenance. Also, in currently available machines, some occasionally necessary adjustments are difficult to make and are frequently required as the machines go out of adjustment/alignment due to constant motion with every cycle.

SUMMARY

The following embodiments and aspects thereof are described and illustrated in conjunction with systems, tools and methods which are meant to be exemplary and illustrative, not limiting in scope. In various embodiments, one or more of the above-described problems have been reduced or eliminated, while other embodiments are directed to other improvements.

The present invention may take the form of a cigarette assembly machine that accepts loose shredded plant material ("SPM") and cigarette blanks that include a filter and an empty SPM holding portion and produces cigarettes. The machine has an SPM slug forming mechanism, adapted to accept loose SPM and form it into a slug of SPM in the shape of the SPM holding portion and a cigarette blank accepting and holding mechanism, adapted to hold the cigarette blank, so that the empty SPM holding portion is facing the SPM slug forming mechanism. Further, a shaft is aligned to the cigarette blank accepting and holding mechanism and a two-stroke shaft moving assembly is adapted to move the shaft through a first stroke, which pushes the SPM slug into the SPM holding portion to create a cigarette, and through a second stroke that moves the cigarette out of the cigarette blank accepting and holding mechanism. Finally, the shaft includes a solid distal push tip, an intermediate brush, and a proximal shaft, whereby as the shaft is moved through its two strokes, the intermediate brush scrubs the SPM slug forming mechanism.

In addition to the exemplary aspects and embodiments described above, further aspects and embodiments will become apparent by reference to the drawings and by study of the following detailed descriptions.

BRIEF DESCRIPTION OF THE DRAWINGS

Exemplary embodiments are illustrated in referenced drawings. It is intended that the embodiments and figures disclosed herein are to be considered illustrative rather than restrictive.

DETAILED DESCRIPTION OF THE PREFERRED EMBODIMENT

Figure 1:
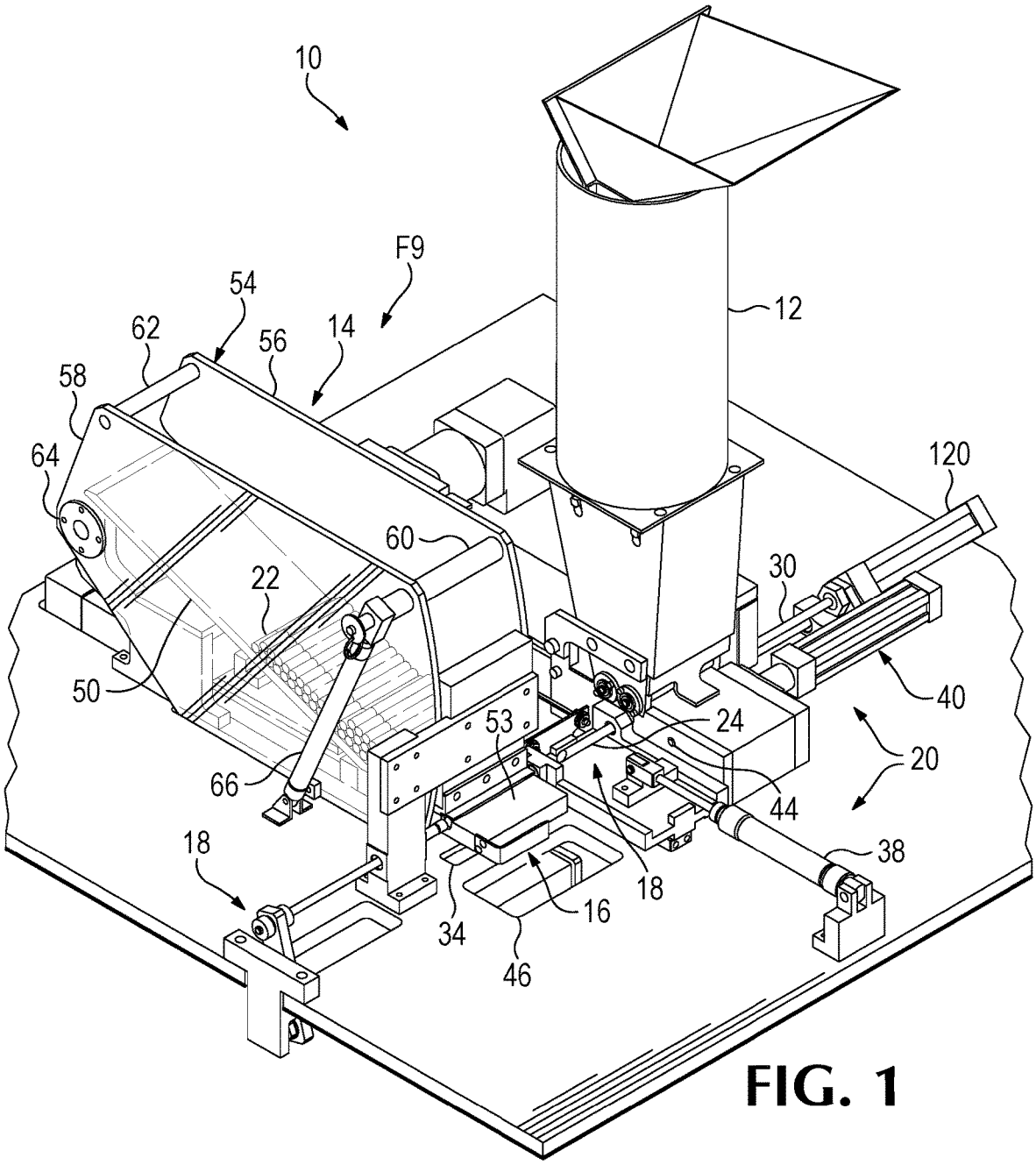
FIG. 1 is an isometric view of a cigarette assembly machine, according to the present invention, taken from a vantage point to the top, front and side of the machine.

Referring to FIG. 1, in gross overview a cigarette assembly machine 10 includes an SPM hopper 12, a blanks hopper 14, a singulation assembly 16, a tube fill assembly 18 and a reject assembly 20. To operate, user loads blanks 22 into blanks hopper 14, and SPM (not shown) into SPM hopper 12. Each blank 22, includes a filter 23, and blanks 22 are introduced into hopper 14, so that the filter side of each blank 22 faces outwardly from the machine 10.

Figure 3:
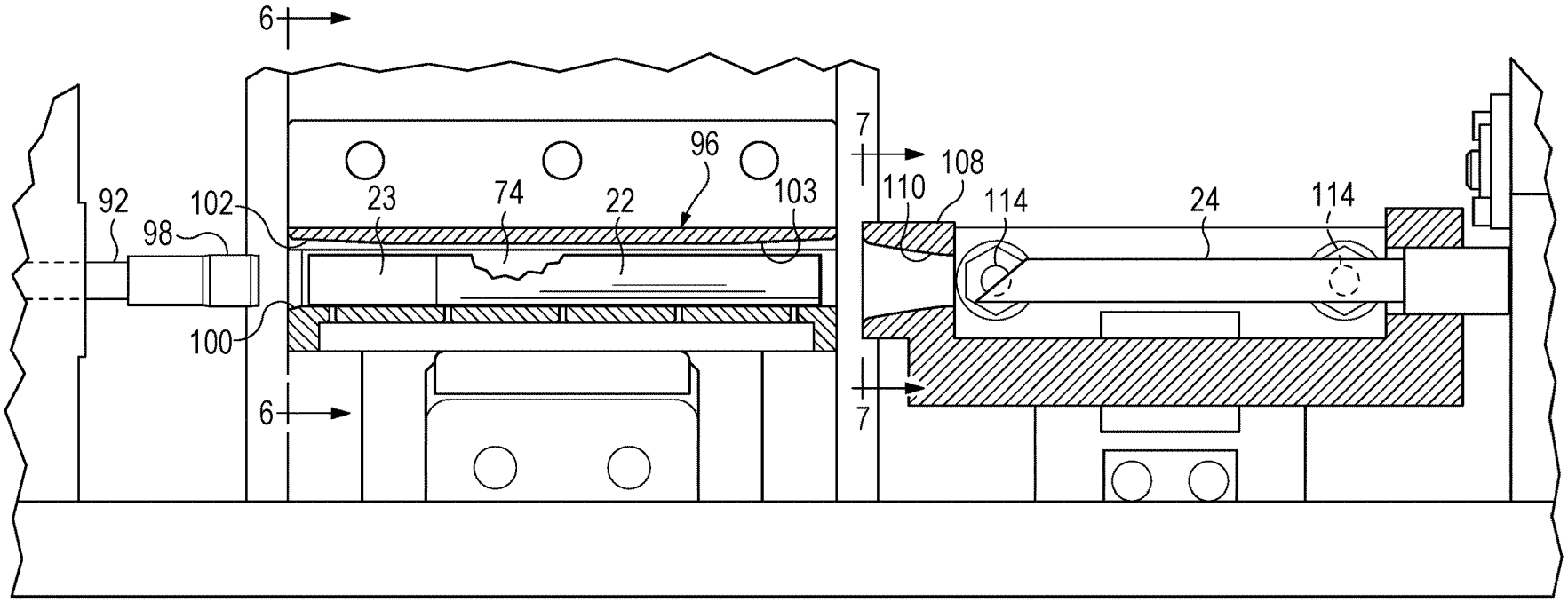
FIG. 3 is a front view of the mechanism for placing a blank on a fill tube, which is part of the machine of FIG. 1. The mechanism is shown with a cigarette blank positioned to be pushed onto a fill tube.

The singulation assembly 16 removes a single blank at a time from blanks hopper 14 and positions it at a predetermined location, so that fill assembly 18 can push a blank 22 onto a fill tube 24. Concurrently, a slug of SPM (not shown) has been formed at the bottom of SPM hopper 12. This slug is pushed by an SPM fill shaft 30 into fill tube 24, and then shaft 30 pushes again, so that the SPM in the fill tube 24 presses against the filter 23 (FIG. 3) that closes each blank 22 at the far end from shaft 30. This pushes blank 22, now filled by SPM off of fill tube 24, thereby freeing the blank 22 so that it can drop into acceptance slot 34.

Reject cases, including an improperly filled, crumpled or torn blank 22 are detected by reject assembly 20, which actuates a first reject pneumatic cylinder 38, moving fill tube 24, so that it is in front of a reject shaft assembly 40, which pushes a reject shaft 42 (FIG. 2) through a reject shaft aperture 44, to push rejected blank 22 off of fill tube 24 and into a reject slot 46.

Figure 6:
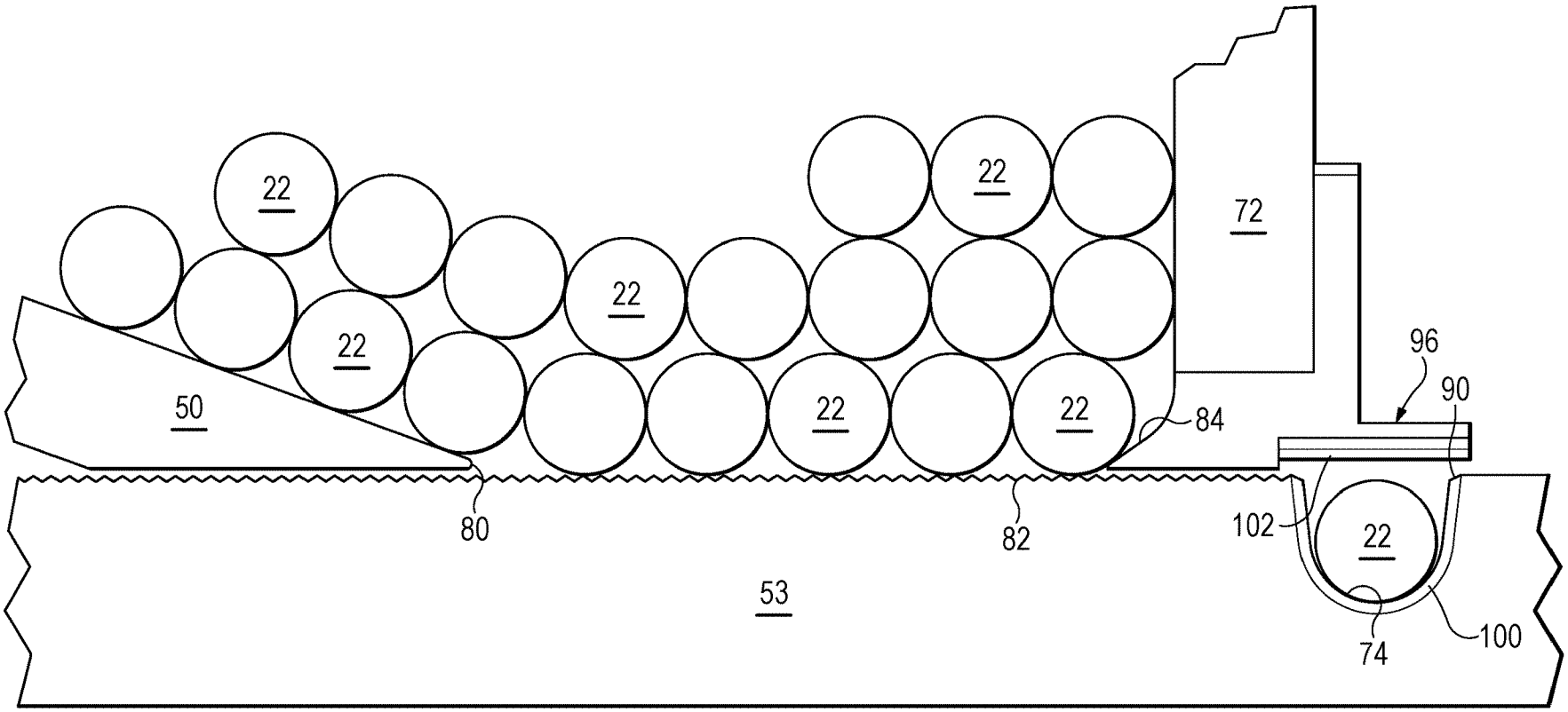
FIG. 6 is a detail sectional view of the machine of FIG. 1, taken along line 6-6 of FIG. 3.
Figure 9:
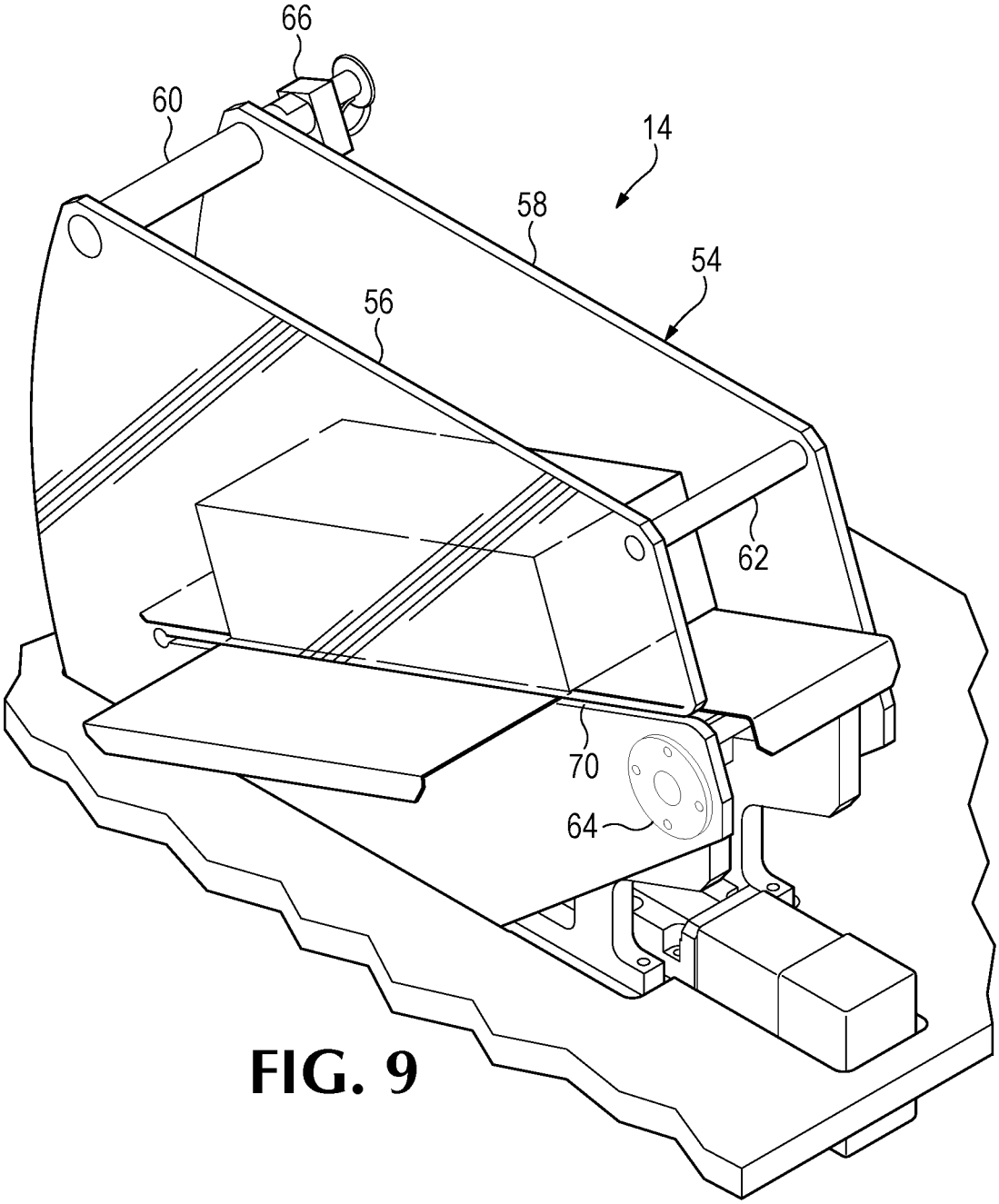
FIG. 9 is an isometric view of the blanks hopper of the machine of FIG. 1, taken from perspective point F9, of FIG. 1.

In greater detail, stepping through the machine 10 by assembly and describing each assembly operation, as best shown in FIGS. 6 and 9, the blanks hopper 14, includes a ramped bottom wall 50. The bottom support for blanks 22 is also provided by the top surface of a shuttle 53, which forms part of singulation unit 16, as well as part of blanks hopper 14. A side wall unit 54 includes an inner sidewall 56, facing the SPM hopper 12, and an opposed outer sidewall 58. Sidewalls 56 and 58 are held together at three points, by a front cross member 60 (which can also serve as a handle), a rear cross member 62 and a hinge 64. A blanks hopper pneumatic cylinder 66 rotates side wall unit 54 about hinge 64, upon command of a user control (not shown), upwardly from the resting position shown in FIG. 1. A slot 70 (FIG. 9) runs through inner sidewall 56 along the top edge of ramped bottom wall 52. A front wall 72 retains cigarette blanks 22 at the front of hopper 14.

Hopper 14 is filled by emptying a standard box of 200 blanks, having a side-hinged lid, into it. In greater detail, the box of blanks is opened, a sheet, roughly as wide as the box, is placed over the top of the box, and the box is flipped over. Then the box is introduced into hopper 14, passing underneath cross member 62, and with the box lid, now swung to the side, accommodated by slot 70. The sheet is removed and the user activates the control to cause cylinder 66 to rotate sidewall unit 54 upwardly about hinge 64, permitting and encouraging the blanks to fall free from the box onto bottom wall 52 and the top surface of shuttle 53. The box is then removed and cylinder 66 is activated to lower unit 52 back to its resting position.

In one preferred embodiment the width of sidewall unit 54, and therefore the width of hopper 14, is adjustable. In one variant, this is achieved by cross members 60, 62 and a portion of hinge 64, being rigidly attached to sidewall 56, to form a replaceable unit. Similar units with longer or shorter cross members are kept on hand and when necessary, sidewall 56 is removed together with the cross members 60, 62 and 64, and on of the replacement units is installed, to create a hopper having a different width, to accommodate longer or shorter blanks.

This process is advantageous over processes for currently available machines, first because the box lid is easily accommodated. Currently available system requires that the lid be cut off or folded awkwardly all the way up, where it can get in the way. Folding the lid requires firm grip on the box which compresses and damages the tube ends. Also, cylinder 66 eases the hopper 14 filling process by relieving the user of the need to manually rotate unit 54.

Figure 4:
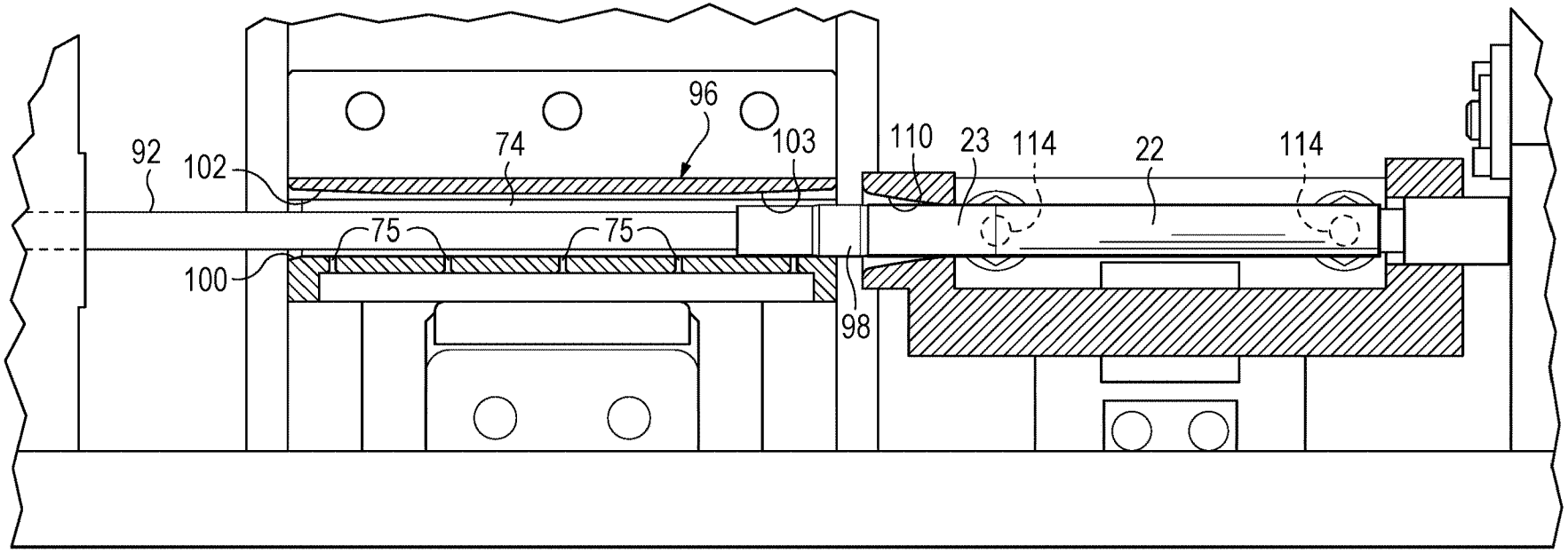
FIG. 4 is a front view of the mechanism of FIG. 3, with the cigarette blank filled most of the way onto the fill tube.
Figure 5:
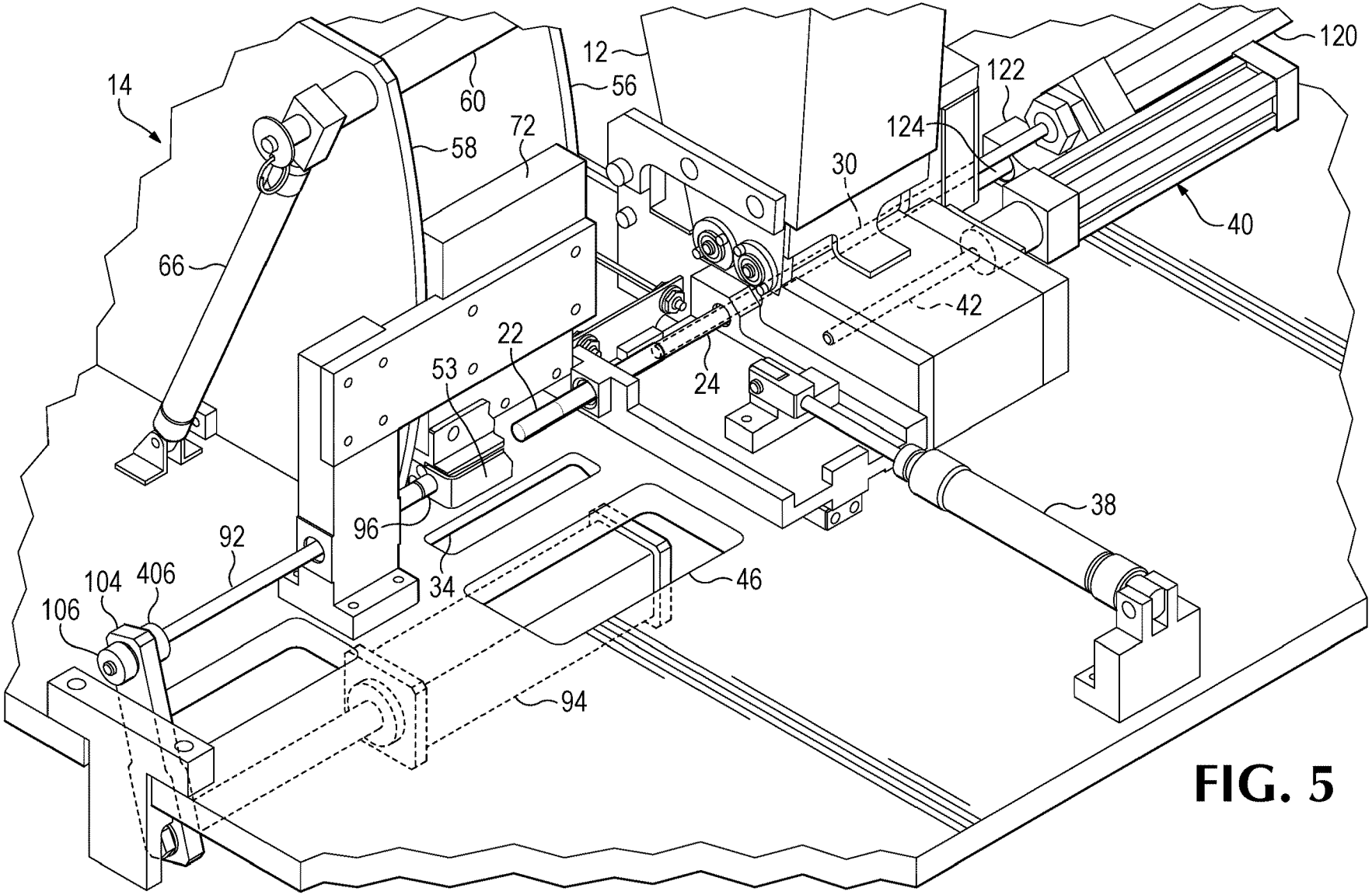
FIG. 5 shows the same view as FIG. 2, with the cigarette blank being pushed off of the fill tube, after having been filled with SPM.

As best shown in FIG. 6, singulation assembly 16 includes as its principal component shuttle 53, defining trough 74, which is shuttled into and out of hopper 14. Trough 74 defines bottom through-holes 75 (FIG. 4), to permit air to exit, to facilitate acceptance of a blank 22 rolling into trough 74. In one preferred embodiment a vacuum source is connected to bottom through-holes 75, to positively urge a blank to enter trough 74. The detailed design of singulation assembly addresses many of the problems found in the prior art. First, the line defined by junction of ramp and shuttle 80 of ramped bottom wall 50, straightens out blanks 22 that have gone askew during the unloading process, as shuttle 53 moves slot 74 toward ramp 50, thereby backing blanks 22 against junction 80. The roughened top surface 82 of shuttle 53 helps with this process by having sufficient friction to move blanks 22 toward ramp tip 80. This movement of the blanks 22, facilitated by the roughened top surface 82, also prevents blanks 22 from forming a bridge, where a set of blanks arches up from front wall 72 to ramp 50, preventing any blanking from falling into a trough 74. Finally, a front lip 84 projecting outwardly from the front wall 72, positions a blank 22 to easily role into trough 74, when shuttle 53 enters hopper 14. Lip 84 is curved like the outside of a blank, to facilitate holding a blank 22 in readiness and to apply well distributed pressure to the blank to keep it from collapsing and to facilitate a blank 22 rolling from lip 84 into trough 74. This helps to prevent competition between blanks, which can result in two blanks partially fitting into trough 74, with each blank 22 preventing the other from falling completely into trough 74.

Another feature of machine 10 that facilitates a blank 22 in falling into trough 74 is the slanted entry lip 90 of trough 74, which encourages a blank 22 to begin rolling into trough 74. The steeper sides of trough 74, however, maintain the blank 22 tightly in correct position, once it has entered.

Figure 2:
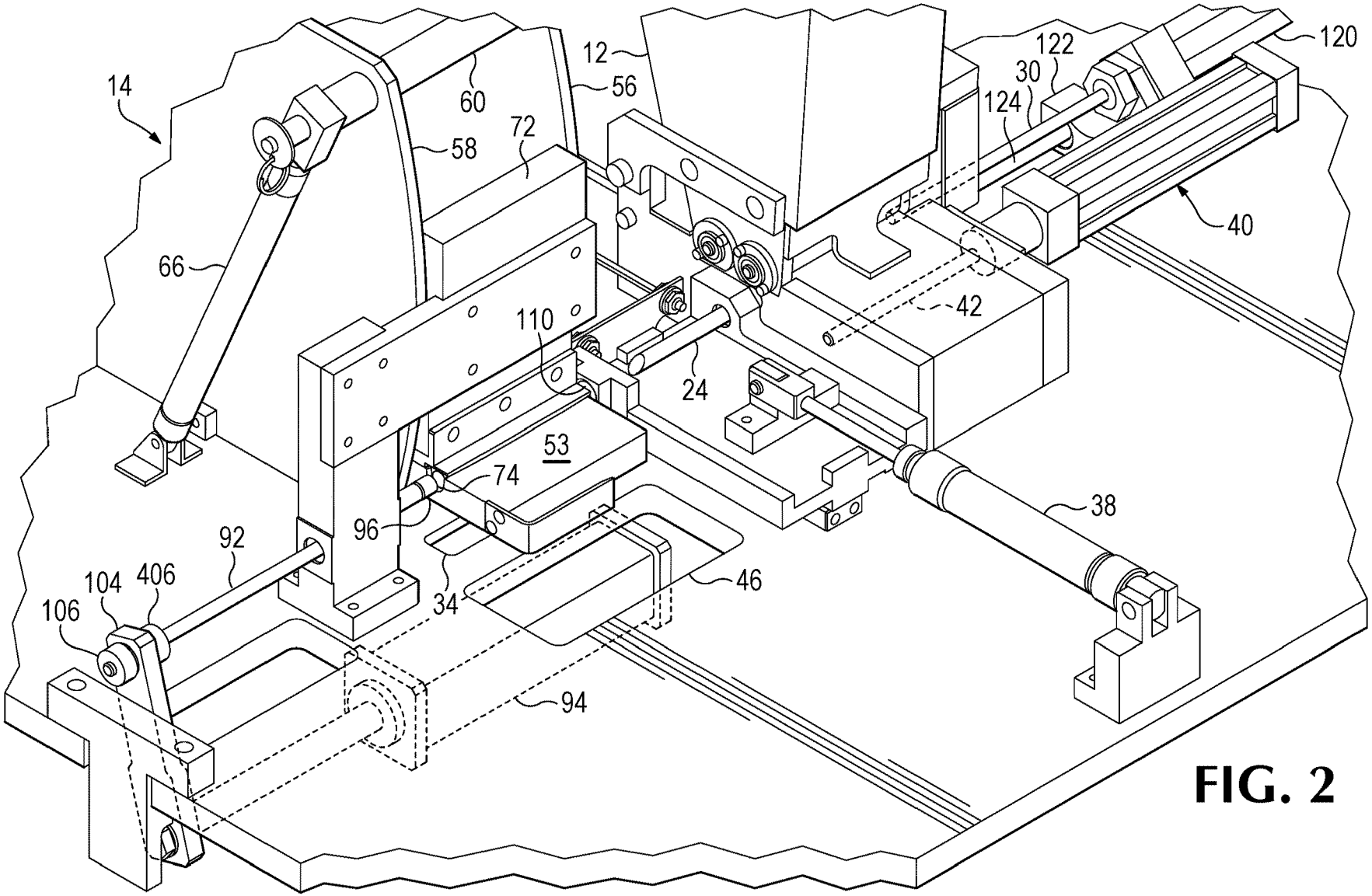
FIG. 2 is an expanded isometric view of the blank filling portion of the machine of FIG. 1, taken from a similar perspective, showing a cigarette blank in position to be pushed onto a fill tube.

Referring, now, to FIG. 2, when shuttle 53 is at its stationary tube-fill position, trough 74 is aligned to fill tube 24. A blank push rod 92, powered by a blank push rod cylinder 94, is aligned with blank 22 and is ready to push blank 22 onto fill tube 24. A cantilevered top wall 96 retains blank 22 as it is pushed by rod 92. One problem that has been encountered in this operation, is that push rod tip 98 (in a previous narrower form than that shown) has been known to push the filter forward in the blank, causing certain failure of the SPM fill operation. Consequently, tip 98 has been widened, in comparison with tips used in previous developmental models. A wider tip, however, has a greater chance of colliding with the sides of trough 74, which could potentially cause a malfunction that could stop operations and even damage machine 10.

A number of design features are addressed at preventing any harmful collision between tip 96 and the sides of trough 74. First, so that any collision will be less harmful, tip 96 is made of a soft material, such as rubber. Trough 74 and top wall 96 have chamfered surfaces 100 and 102 facing blank 22, at the entry-point for rod 92, to lessen the possibility of tip 98 missing the chamfered opening and hitting top wall 96, or the shuttle 53. The top wall also defines a chamfered lower surface 103 on the side closer to the fill tube 24 to prevent finished cigarette from hitting edge when ejected. Rod 92 is attached to a vertical arm 104, which is moved by cylinder 94. The mounting fixture 106 of rod 92 on vertical arm 104 is loose, permitting up to 0.020 inches of play, so that if tip 98 hits the walls of trough 74, tip 98 can easily travel a little to the side so that it can slide into trough 74, even in the case of minor misalignment.

Figure 7:
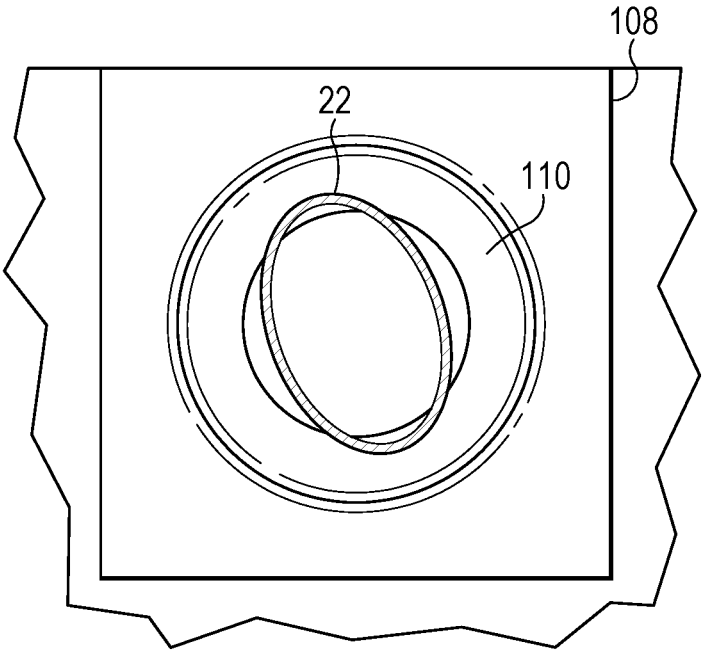
FIG. 7 is a detail sectional view of the machine of FIG. 1, taken along line 7-7 of FIG. 3, and showing a blank in the process of entering the round shaping element.
Figure 8:
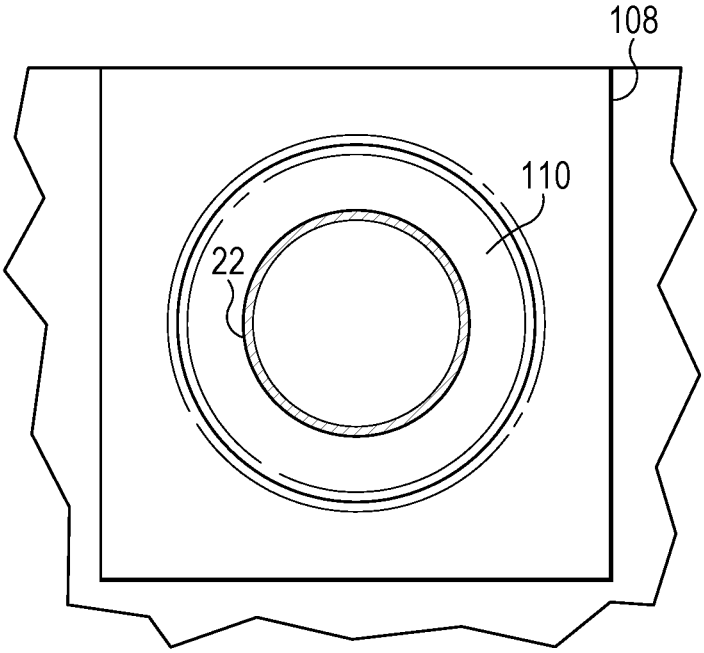
FIG. 8 shows the same detail section view of FIG. 7, but in this case, the blank has been forced into a round transverse shape by the round-shaping element.

In the process of pushing a blank 22 from trough 74 onto fill tube 24, the blank 22 is pushed through a round-shaping element 104, which defines a round, necked-down passageway 110. Referring to FIGS. 7 and 8, if a blank 22 is not circular in cross-section, passageway 110 presses inwardly upon the outward portions, forcing blank 22 into a circle. This greatly facilitates the operation of pushing blank 22 onto fill tube 24, as a misshapen blank 22 is likely to catch on fill tube 24, rather than sliding onto it.

After blank 22 has been slid onto fill tube 24, a pair of optical sensors 114 each transmit a beam of light (LED or laser) toward blank 22 and measure the return signal to determine if blank 22 is fully on fill tube 24. Return from both the brown filter portion of the blank can be distinguished from the stainless steel of the fill tube 24, in addition to the white paper of the remainder of the blank 22. In addition to failing to be placed all the way onto the fill tube 24, a blank could be torn, thereby exposing fill tube 24 in front of the sensor 114 that is closer to passageway 110. If a damaged or improperly positioned blank is detected, it is disposed of by assembly 20, as described earlier.

Both sensors must register proper tube placement contemporaneously with the placement of blank 22 on fill tube 24, a slug of SPM sized to fit into a blank 22 is formed, according to well-known techniques, in a portion (not shown) of the blank fill assembly 18, beneath SPM 13. When the SPM slug has been formed, and blank 22 has been positioned (and verified) on fill tube 24, the fill shaft 30 pushes the slug of SPM into fill tube 24. Fill shaft 30 then advances again, pushing the slug of SPM against the closed filter portion of the blank 22, which acts to push the blank 22, retaining the SPM, off of fill tube 24. The finished cigarette then falls down the acceptance slot 34. So that shaft 30 can advance twice, a fill shaft pneumatic cylinder 120 is piggy-backed onto a carriage servomotor 122, that moves along a set of guide rods 124, with the carriage servo 122 providing the first push, to fill tube 124, and the fill tube cylinder 120 advancing to provide the second push, to eject the blank 22. In another embodiment the carriage servomotor performs both the fill and eject strokes.

Figure 10:
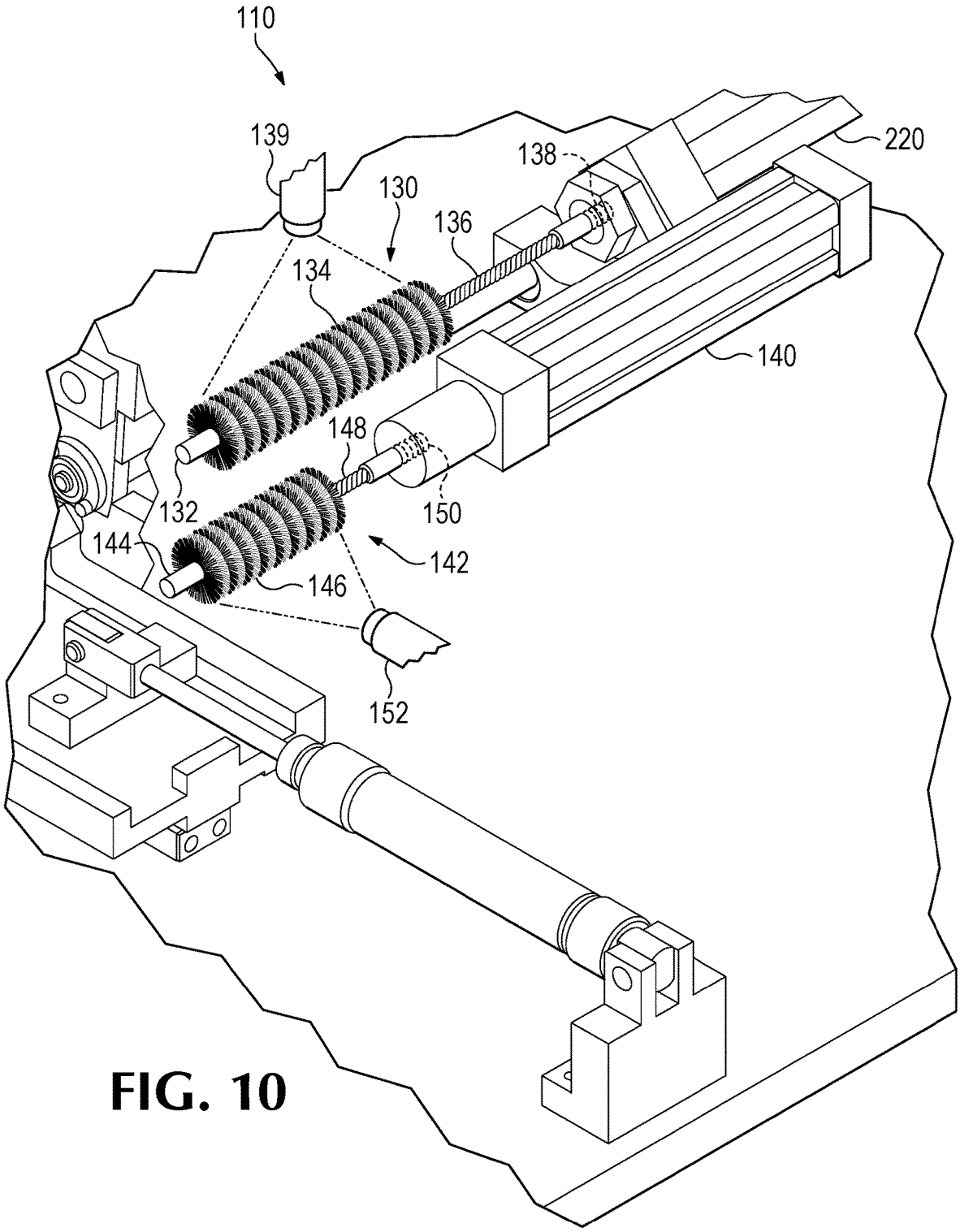
FIG. 10 is an isometric cut-away view of a portion of the machine that is the same as that of FIG. 1, except for in the region shown.

Referring now to FIG. 10, in an alternative preferred embodiment of a cigarette assembly machine 110, shafts 130 and 142 are modified versions of shafts 30 and 42 in embodiment 10. Each shaft 130 and 142 includes a push tip 132 and 144, a brush 134 and 146, a proximal shaft 136 and 148, and a helically threaded proximal end 138 and 150, all respectively to shafts 130 and 142. Helically threaded proximal ends are screwed into receptively threaded receiving units, that are both a part of cylinders 220 and 140, respectively. Consequently, as the push tip 132 of the shaft 130 pushes the slug of tobacco into the fill tube, and then also on the second push, to push the formed cigarette out of the fill tube, the brush 134 cleans the SPM slug forming mechanism (not shown) at the bottom of the SPM hopper 12, including a knife edge (not shown). In like manner, when cylinder 40 pushes shaft 142, to push out a defective tube, a cleaning operation is performed by brush 146. When either brush 134 or 146 has become worn, shaft 130 or 142 can be replaced by unscrewing the threaded proximal end 138 or 150, respectively from the receiving unit (not shown), and replacing with a new shaft 138 or 150. Finally, spray reservoirs 139 and 152 spray brushes 134 and 146, with lubricating oil, such as palm oil.

While a number of exemplary aspects and embodiments have been discussed above, those possessed of skill in the art will recognize certain modifications, permutations, additions and sub-combinations thereof. It is therefore intended that the following appended claims and claims hereafter introduced are interpreted to include all such modifications, permutations, additions and sub-combinations as are within their true spirit and scope.

The invention claimed is:

1. A cigarette assembly machine that accepts loose shredded plant material ("SPM") and cigarette blanks that include a filter and an empty SPM holding portion and produces cigarettes, comprising:

(a) an SPM slug forming mechanism, adapted to accept loose SPM and form it into a slug of SPM in the shape of said SPM holding portion;

(b) a cigarette blank accepting and holding mechanism, adapted to hold said cigarette blank, so that said empty SPM holding portion is facing said SPM slug forming mechanism; and (c) a shaft aligned to said cigarette blank accepting and holding mechanism; and (d) a two-stroke shaft moving assembly, adapted to move said shaft through a first stroke, which pushes said SPM slug into said SPM holding portion to create a cigarette, and through a second stroke that moves said cigarette out of said cigarette blank accepting and holding mechanism; and (e) wherein said shaft comprises a solid distal push tip, an intermediate brush, and a proximal shaft, whereby as said shaft is moved through its two strokes, said intermediate brush scrubs said SPM slug forming mechanism.

2. The machine of claim 1, wherein said solid distal push tip and said intermediate brush together form a distal shaft portion that is removeable from said proximal shaft, thereby permitting removal from said proximal shaft when soiled with damp fill material, and replacement with a fresh distal shaft portion.

3. The machine of claim 2, wherein distal shaft portion is threaded at its proximal end and said proximal shaft is threaded, in complementary manner at its distal end, so that said distal shaft portion screws into said proximal shaft.

4. The machine of claim 1, further including a spray reservoir, to spray lubricating oil onto said brush.

* * * * *